United States Patent [19]

Griswold et al.

[11] 4,003,779

[45] Jan. 18, 1977

[54] MICROFICHE MOUNTER

[75] Inventors: Augustus W. Griswold, Rush; Boris W. Haritonoff, Geneseo; Angus W. Westkirk, Springwater, all of N.Y.

[73] Assignee: Dynak, Inc., Rochester, N.Y.

[22] Filed: May 12, 1975

[21] Appl. No.: 576,796

[52] U.S. Cl. ..... 156/353; 156/510; 156/562; 156/566

[51] Int. Cl.[2] ..... B26D 5/00

[58] Field of Search ..... 156/353-355, 156/361-364, 378-379, 566, 108, 513-514, 516, 517, 510-511, 584, 561, 562; 235/61.12 R, 61.11 E, 61.6 H

[56] References Cited

UNITED STATES PATENTS

| | | | |
|---|---|---|---|
| 3,194,709 | 7/1965 | Bondhus | 156/108 X |
| 3,641,319 | 2/1972 | McGuire | 235/61.12 R |
| 3,791,903 | 2/1974 | Omi et al. | 156/108 X |

*Primary Examiner*—David A. Simmons
*Attorney, Agent, or Firm*—George W. Shaw

[57] ABSTRACT

A microfiche mounter is fully automatic and uses preprogrammed instructions from either a computer or a filmstrip in placing the image frames of the filmstrip in predetermined destination regions of a transparent base to make or update a microfiche. The mounter receives instructions and displays information enabling an operator to select the proper base for placement on the machine. The mounter then advances a filmstrip into a transfer device, cuts off a proper length of the filmstrip, pivots the transfer device over the base, moves the base in X and Y coordinates to register the destination region of the base under the transfer device, insures accurate registry between the base and the transfer device, and presses the filmstrip from the transfer device into engagement with the base for adhesively securing the filmstrip to the base. All this is done fully automatically, and the machine also has the capacity for manual operation of each step or keyboard entry of mounting instructions. The machine also switches between different modes of operation, monitors its operations, and displays indications of events or errors occurring during operation. It is faster, more efficient, and much more accurate than previous equipment for making microfiche.

46 Claims, 20 Drawing Figures

MICROFICHE MOUNTER

BACKGROUND OF THE INVENTION

Microfiche are generally known and are formed of transparent cards or bases bearing rows and columns of image frames. Some microfiche are of an "assembled" type wherein individual frames or groups of frames are cut from a roll of film and mounted on a transparent base or card. The present invention relates to mounters for use in making microfiche of the assembled type.

Different sized bases, different widths of filmstrips, different frame sizes, and different numbers of rows and columns are possible and have been used. A length of filmstrip having a succession of frames of microimages has an adhesive strip along each side edge with a protective or release strip covering the adhesive. To mount the image frames, the release strips are peeled off the adhesive strips, a frame or a number of frames are cut from the leading end of the filmstrip, and the cut-off length is secured to the base by pressing it in the proper location to secure an adhesive bond. Some frames on a microfiche can be permanent, other frames can be removed and replaced, and a microfiche can be completely or partially filled with frames when originally made and can have other frames substituted for original frames or added to original frames at a later time.

In the prior art, image frames were mounted on a microfiche base by semi-automatic equipment that required considerable human intervention and manual operations. Coded instructions were transmitted to the machine from a computer. The machine decoded the instructions and indicated to an operator where the images were to be mounted. The machine also advanced the filmstrip, peeled off the release strips, and cut away the number of image frames called for by the coded instructions, and the operator manually mounted the cut-off film on the base with the aid of a vacuum tool and an alignment grid overlying the base. The machine projected images and displayed coded information to assist the operator in locating the destination for the image frames, but operator error caused substantial problems in misplacing image frames and misregistering the image frames with their destination regions. Such mounting was also relatively slow and expensive and proved even more costly from errors in registration or placement.

The invention involves recognition of the problems in prior art mounting of microfiche and realization of ways to solve the problems and make a fully automatic machine that is fast and accurate in both placing and registering image frames on a microfiche base. The invention aims at economy, reliability, accuracy, and savings in labor, material, and time in making or mounting microfiche. The inventive apparatus provides fully automatic equipment responsive to data stored in or produced by a computer or by instructions encoded on a filmstrip to accomplish all the operations necessary in mounting image frames on a microfiche base, including filmstrip advancing, positioning, cutting, displaying of images and code material, automatic mounting, monitoring of machine operations, displaying indications of machine operations and any possible errors, allowing manual control, and accommodating keyboard entry of instructions.

SUMMARY OF THE INVENTION

The invention is automatic apparatus using pre-programmed instructions for applying the image frame of a filmstrip to predetermined destination regions of a microfiche base. It includes a control for receiving and implementing instructions from a computer or from the filmstrip itself. A transfer device receives and holds a predetermined length of the filmstrip, which is advanced into the transfer device in response to the control. The filmstrip is then cut in the interframe region behind and adjacent to the length advanced into the transfer device. A microfiche base is mounted on a support that is movable relative to the transfer device in response to the control means to bring the base into a predetermined relationship with the transfer device for accurately positioning a predetermined destination region of the base in registry with the piece of filmstrip in the transfer device. Then a device automatically presses the piece of filmstrip from the transfer device accurately into engagement with the destination region of the base for securing the film piece to the base.

The base is preferably moved by X and Y coordinate drives to an approximately proper position and then is accurately positioned by a locater pin seating in a recess in a locater plate that moves with the base support. The transfer device is preferably movable between a filmstrip receiving position and a filmstrip delivery position over the base, and the transfer device preferably has an opposed pair of clamp bars for engaging the lateral side edges of the filmstrip to hold the filmstrip in place. A depositor bar is preferably mounted between the clamp bars of the transfer device, and a presser bar preferably engages and pivots the depositor bar downward to press one edge of the film piece against the base. Then after the transfer device has retracted, the presser bar preferably presses down on the whole film piece to complete the adhesive bond to the microfiche base.

DRAWINGS

DETAILED DESCRIPTION

Figure 1:
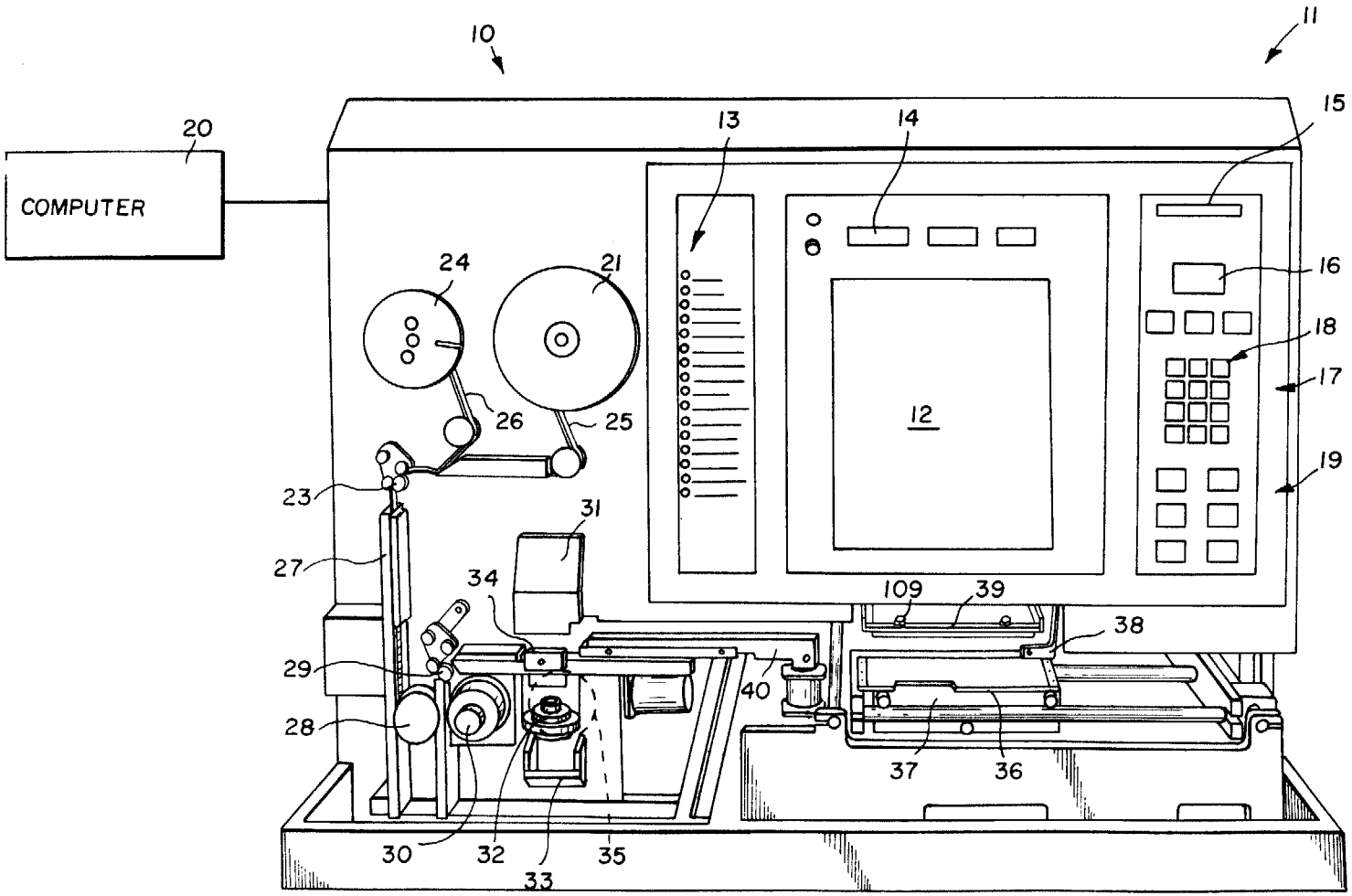
FIG. 1 is a front elevational view of a preferred embodiment of the inventive apparatus with covers removed to expose some of the internal parts.

A preferred embodiment of the inventive microfiche mounter 10 is best shown in FIG. 1, where machine 10 is illustrated with covers removed for a better view of some of its working parts. It includes a display panel 11 having a viewing screen 12 where images from a filmstrip are displayed to the operator, a diagnostic panel 13 for indicating events or errors in machine operations to aid in solving any problems, and data displays 14 and 15 for respectively indicating the fiche being mounted and the specific mount sequence being processed. A counter 16 indicates the total mounts made, and a control panel 17 includes a keyboard 18 for manual entry of mounting data and operational buttons 19 for manual control of machine operations.

Machine 10 can operate either on instructions from a computer 20 or from instructions encoded on a filmstrip 25. As filmstrip 25 is made by photographing documents, code information can be made, preferably between the frames on the filmstrip, or instructional information relative to the frames on the filmstrip can be recorded on tape or on cards or other media or stored in the memory of computer 20. Then when the filmstrip is to be cut up into pieces and mounted on a microfiche base, the instructions are read or retrieved by computer 20 and fed to machine 10 or are read from the filmstrip by machine 10, which then automatically accomplishes the predetermined mounting of the image frames of filmstrip 25.

The backside of filmstrip 25 has a pair of adhesive strips 22 (best shown in FIGS. 13–15) covered by release strips 26, and the adhesive strips 22 and their covering release strips 26 are applied either before or after filmstrip 25 is developed and processed. Although film strips for use in making the assembled microfiche described herein are provided with adhesive strips, such as narrow strips of double-faced tape, adjacent the top and bottom edges thereof, in some installations only a single adhesive strip is used. In addition, the adhesive strip or strips may be carried by the base rather than by the film strip. Microfiche have also been made in which no separate adhesive is used, but rather the frames are releasably adhered to the base which may be soft vinyl material, by molecular attraction or adhesion between the frames and base. The terms "adhesive" or "adhesively" when used herein include the above described molecular attraction or adhesion as well as the use of one or two strips of separate adhesive material applied to either the film strip or the base. Although the present invention is described in connection with a film strip having an adhesive strip adjacent the top and bottom edges of the film strip, this is for the purposes of illustration only as the machine may be used with the other types of film strips described above.

When it is time for mounting the image frames of filmstrip 25, a supply reel 21 of filmstrip 25 is mounted on machine 10, and filmstrip 25 is fed to a drive spindle 23 for advancement into machine 10. Just ahead of drive spindle 23, release strips 26 are peeled from filmstrip 25 and coiled on a takeup reel 24. Filmstrip 25 then has exposed adhesive strips 22 as it passes along film guide 27, under dancer roll 28, over another film drive spindle 29, and into the region of a manual film advance 30. A viewing region for filmstrip 25 includes a projection light source 31, a lens 32, and a mirror 33 cooperating with other components to display an image frame on viewing screen 12. A photocell sensor assembly 34 is arranged in the viewing region for reading code marks on the filmstrip illuminated by an alternative light source 35, and other light sources better shown in FIG. 2 illuminate the edge of the filmstrip where fiducial marks are arranged relative to each frame for proper positioning of the filmstrip.

After filmstrip 25 is threaded up and its leader removed, machine 10 retracts two frames to bring the first image frame into the viewing region and displays it on viewing screen 12 where the operator can check the data display 14 against the data visible on screen 12 and can cross-check this against the proper microfiche base which the operator mounts on fiche deck 36 supported on a table 37 that is moved by an X and Y coordinate drive mechanism. Then for automatic operation, the operator presses a "next event" button in control button array 19, and according to instructions from computer 20 or from filmstrip 25, machine 10 advances filmstrip 25 into transfer arm 40 until a predetermined number of image frames are lodged in transfer arm 40. Machine 10 then stops the film, positions it accurately, and cuts it off with a cutter 41 that cuts in the interframe region of filmstrip 25. Transfer arm 40 then pivots over fiche deck 36 and engages an adjustable stop 38.

Meanwhile, fiche deck 36 moves to a position that registers a destination region with transfer arm 40 for receiving the film piece in transfer arm 40 at the proper place on a fiche base on deck 36. Then a presser bar 39 moves downward to engage a filmstrip release mechanism in transfer arm 40 to press one edge of the film piece against the fiche base to secure said edge of the film piece accurately in place. Presser bar 39 retracts, transfer arm 40 moves back toward its illustrated position, and presser bar 39 moves down against the fiche base to press the film piece securely against the base and complete the adherence of the film piece in place. Machine 10 then continues with film advancement, cutoff, and mounting operations in accordance with instructions until the microfiche is completely filled or the image frames intended for the microfiche are all mounted. Machine 10 then stops and signals the operator who removes the microfiche from deck 36, views the next image and the next instructions, mounts a new fiche base on deck 36, and repeats the process.

Machine 10 monitors its own operation, indicates both events and errors on diagnostic panel 13, and stops whenever appropriate so that any errors can be corrected. The keyboard and control buttons on panel 17 can be used for scrapping portions of a filmstrip or manually entering mounting instructions for any frames lacking instructions. Also, mounting can be accomplished a step at a time under manual control, and control panel 17 and diagnostic panel 13 can be used manually for troubleshooting any problems in machine 10.

There are many different ways that the logic and operation of machine 10 can be varied, and the invention covers the equipment involved rather than circuitry, sequences, or operational logic. Except for the operator involvement in threading up filmstrip 25 and mounting and demounting fiche bases, machine 10 is fully automatic and responsive to any circumstances that may be encountered. It is also faster and more accurate, versatile in receiving various instructions and dealing with problems, and is easily diagnosed and serviced. Some of the particular components and features that contribute to the success of machine 10 are explained below.

FILMSTRIP FEEDING, POSITIONING, AND CUTTING

Figure 2:
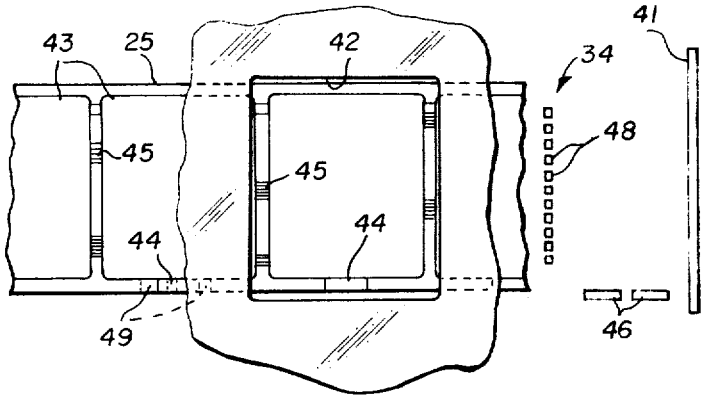
FIG. 2 is a plan view of a filmstrip at a viewing region of the apparatus of FIG. 1.

The driving and advancing of filmstrip 25 is generally known up to the viewing region where machine 10 accurately positions the filmstrip for reading code indicia, cutting, and displaying an image on screen 12. As best shown in FIG. 2, a viewing gate 42 is arranged in the viewing region so that light can be directed through filmstrip 25 for displaying an image frame for the operator to view. Filmstrip 25 has a succession of image frames 43, and each frame 43 preferably has a fiducial mark 44 centered along the marginal edge of the frame for use in counting frames and positioning frames accurately for cutoff. When machine 10 operates by instructions from computer 20, fiducial marks 44 are all that is needed, but when machine 10 operates by filmstrip instructions, such instructions are preferably binary coded data 45 arranged transversely of filmstrip 25 in the region between frames 43 are illustrated.

When filmstrip 25 is advanced under control of computer 20, fiducial marks 44 are counted by a pair of photocells 46 to stop the filmstrip in the proper position for cutoff knife 41 which operates in, and preferably removes, the interframe region between frames 43. Filmstrip 25 is accurately positioned for a cut by centering a fiducial mark 44 between photocells 46 that are illuminated by a light source to determine where the centered fiducial mark evenly blocks a portion of the light falling on each of the photocells 46. Code data 45 immediately behind the leading frame 43 centered at photocells 46 is read by a transverse array of photocells 48 for sensing instructions 45 as to the type of fiche, the coordinates for mounting the fiche on a fiche base, and other information. If the leading frame is to be viewed by light passing through viewing gate 42, machine 10 moves filmstrip 25 backward two frames to center a fiducial mark 44 on photocells 49 to position the leading frame in viewing window 42 where both the image on the frame and the associated data 45 are displayed.

Figure 4:
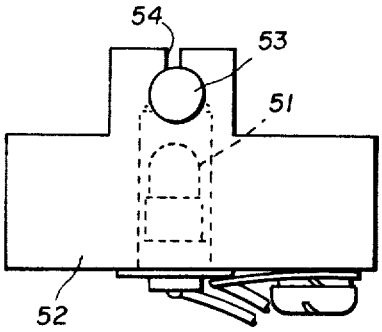
FIG. 4 is an enlarged, side elevational view of the illuminator of FIG. 3.
Figure 3:
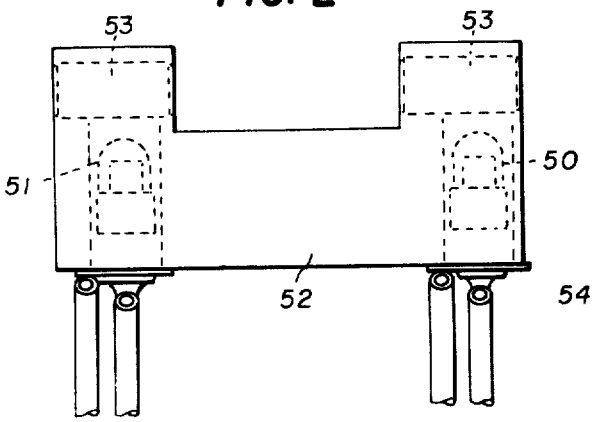
FIG. 3 is an enlarged, front elevational view of a preferred embodiment of an illuminator of the fiducial mark region of the film in the apparatus shown in FIG. 1.
Figure 5:
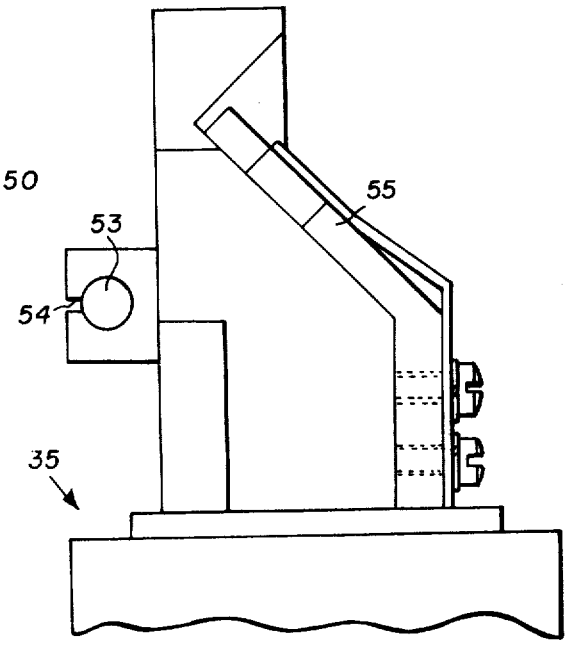
FIG. 5 is an enlarged, side elevational view of another embodiment of an illuminator for the encoded data and fiducial mark regions of the film in the apparatus shown in FIG. 1.
Figure 6:
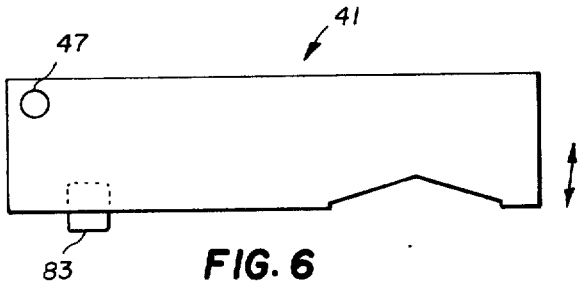
FIG. 6 is an elevational view of a cutoff knife for the apparatus of FIG. 1.

As best shown in the enlarged views of FIGS. 3 and 4, a pair of lamps 50 and 51 are arranged in a holder 52 and mounted under the film path for respectively illuminating photocell pairs 46 and 49. Holder 52 has a transverse cylindrical lens 53 over each of the lamps 50 and 51 for focusing and axially scattering light that is directed out through an axial slot 54 to form a bar of light registered with photocells 46 and 49. Machine 10 moves filmstrip 25 until each photocell of one of the pairs 46 and 49 sees an equal amount of light indicating proper centering of a fiducial mark 44.

When machine 10 operates by instructions 45 on filmstrip 25, lamp 50 for illuminating photocell pair 46 is replaced by an alternative lamp 35 that is arranged for directing light across filmstrip 25 via a mirror 55 that illuminates both code instructions 45 and fiducial mark 44 relative to photocells 46.

Cutoff knife 41 pivots on a pin 47 and preferably has an angled cutting notch 54 that moves between a die (not shown) for cutting filmstrip 25 inward from both edges at the same time. This helps keep filmstrip 25 from slipping during a cut. Also, the return of knife 41 to its home position above the filmstrip is detected by a photocell 83, which produces an error signal at diagnostic panel 13 (FIG. 1) if knife 41 sticks in a downward position.

TRANSFER DEVICE

Figure 7:
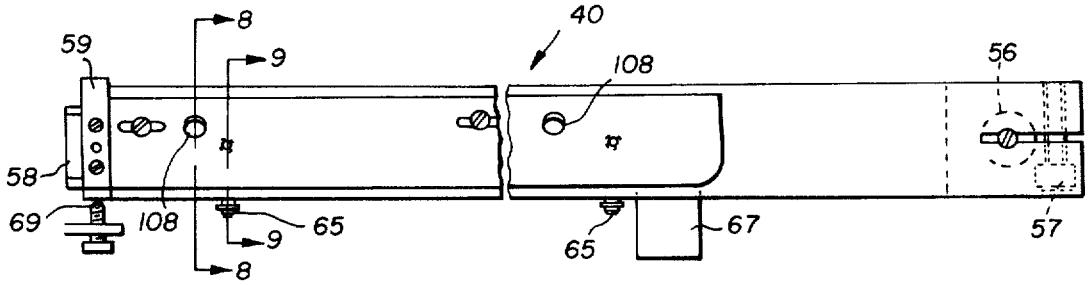
FIG. 7 is a partially cut-away, plan view of a preferred embodiment of a transfer arm for the apparatus of FIG. 1.
Figure 8:
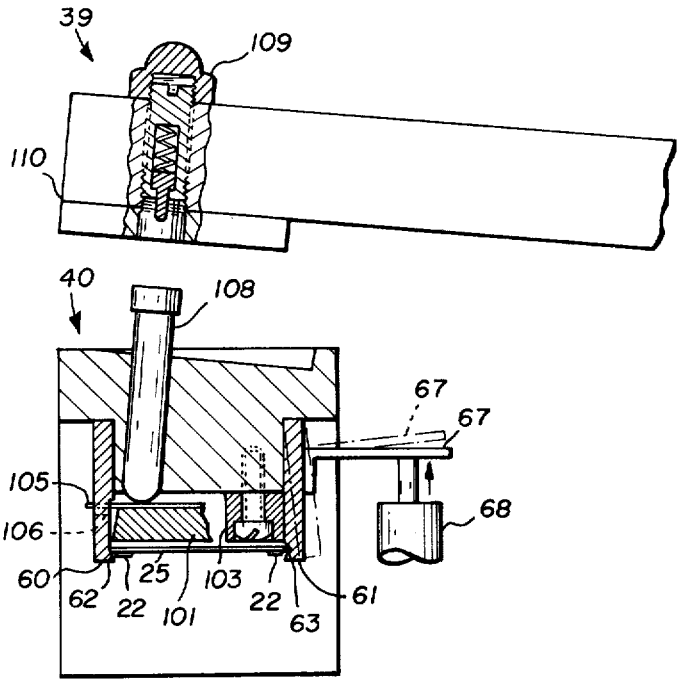
FIG. 8 is a cross-sectional view of the transfer arm of FIG. 7 taken along the line 8—8 thereof, and adding a presser bar above the transfer arm.
Figure 9:
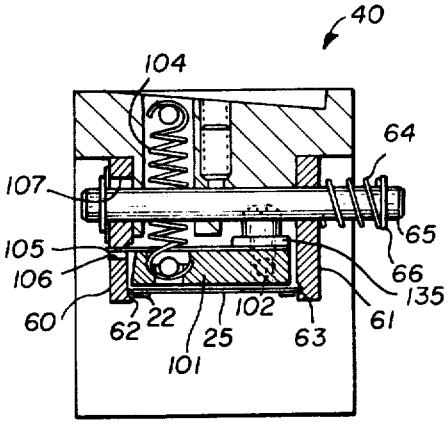
FIG. 9 is a cross-sectional view of the transfer arm of FIG. 7, taken along the line 9—9 thereof.

Transfer arm 40 is best shown in FIGS. 7–9. Arm 40 is clamped on a vertically oriented shaft 56 by screw 57 and extends from there toward a film receiving end 58. A stop plate 59 near the receiving end 58 of transfer arm 40 engages the adjustable stop 38 shown in FIG. 1 and another stop 69 at its home or film-receiving position. Arm 40 carries a rear clamp plate 60 and a front clamp plate 61 for engaging the lateral side edges of filmstrip 25. The lower end 62 of rear clamp plate 60 is formed in a dovetail-shaped taper, and the lower region of front clamp plate 61 has a longitudinal notch 63 so that the edges of filmstrip 25 are supported in notch 63 and at the upper end of taper 62. Clamp plates 60 and 61 extend longitudinally of transfer arm 40 for slightly more than the total length of a row of frames on the microfiche base so that an entire row of image frames can be fed in between clamp plates 60 and 61, cut off, and transferred to a fiche base.

A pair of springs 64 encircling pins 65 are compressed between fixed washers 66 and front clamp plate 61 to bias front clamp plate 61 to the position illustrated in FIG. 9 for engaging the edge of filmstrip 25. An arm 67 is secured to front clamp plate 61 and extends outward as best shown in FIGS. 7 and 8 where it can be engaged by a solenoid 68 and raised to the position shown in broken lines in FIG. 8 to open front clamp plate 61 relative to rear clamp plate 60 for accepting a length of filmstrip 25.

When transfer arm 40 is in the home or film-receiving position with stop plate 59 engaging adjustable stop 69, solenoid 68 operates to move clamp plate 61 away from clamp plate 60 against the bias of springs 64 for receiving a length of filmstrip 25. Then solenoid 68 is de-energized so that clamp plate 61 moves toward clamp plate 60 to grip the edges of filmstrip 25 to hold filmstrip 25 securely during cutting. Transfer arm 40 then pivots as previously described and as explained in more detail below to deposit the cut off length of film in the proper position on a fiche base.

FICHE DECK

Figure 10:
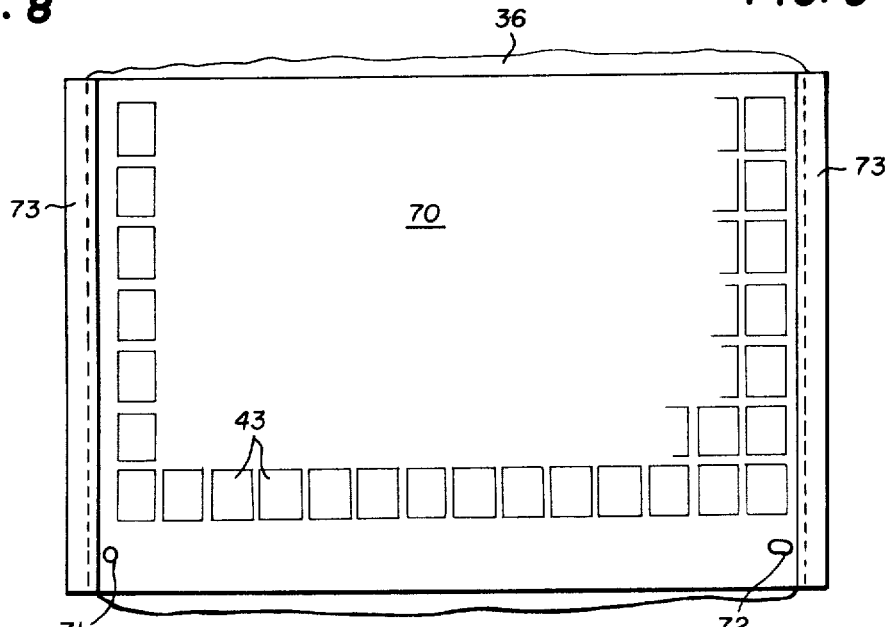
FIG. 10 is a fragmentary plan view of a fiche deck for the apparatus of FIG. 1.
Figure 11:
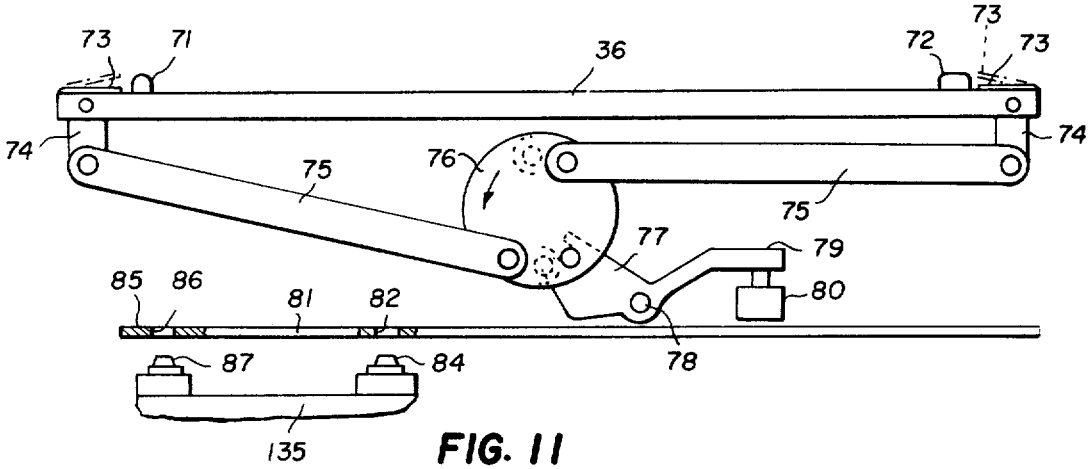
FIG. 11 is a fragmentary, side elevational view of the fiche deck of FIG. 10.
Figure 12:
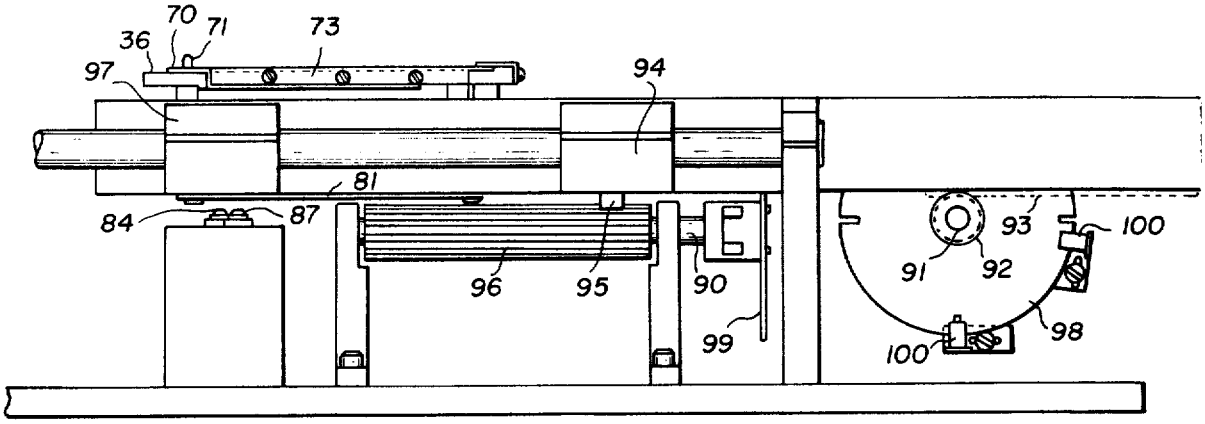
FIG. 12 is a fragmentary, elevational view of an X and Y coordinate drive mechanism for the fiche deck of the apparatus of FIG. 1.

Fiche deck 36 and its X and Y coordinate drive mechanism is best shown in FIGS. 10–12. A fiche base 70 is positioned on fiche deck 36 as best shown in FIG. 10 and is properly located by means of a circular locating pin 71 and an oval locating pin 72. The end edges of fiche base 70 are held down by clamps 73 that are pivoted by links 74 operated by arms 75 connected to a crank disk 76 that is pivoted by an arm 77 on a shaft 78 turned by an arm 79 and a solenoid 80 as best shown in FIG. 11. The operator places fiche base 70 on pins 71 and 72 when clamps 73 are open, and fiche deck 36 is in a home position, and then crank disk 76 pivots to bring clamps 73 down over the ends of fiche base 70 before machine operations start.

Locater plate 81 moves with fiche deck 36, and plate 81 has a generally circular recess or hole 82 corresponding to each image frame position available on fiche base 70. Fiche deck 36 moves to the approximate position relative to the transfer arm for receiving a piece of film, and an arm 135 (described below) raises a pin 84 having a generally conical or tapered upper end into a recess 82 for locking or detenting fiche deck 36 precisely into the right position to insure accurate placement of the film piece 25 on fiche base 70. The illustrated machine 10 is made to operate with a fiche base 70 having seven rows and fourteen columns, for a total of 98 frame locations, and locater plate 81 has 98 circular recesses 82 corresponding to the frame locations. Of course, other numbers of rows and columns can also be used with a corresponding change in the number of recesses 82.

Locater plate 81 has a generally circular recess hole 86 engaged by a pin 87 having a generally conical or tapered upper end for accurately establishing the home position for fiche deck 36. The home position with pin 87 lodged in recess hole 86 is used for loading and unloading fiche deck 36 and also provides an accurate starting point for measuring travel to other positions. Fiche deck 36 can move from one position to another without returning to the home position, and can move in both coordinates simultaneously for speedier operation.

The X and Y coordinate drive for fiche deck 36 is best shown in FIG. 12. A pair of reversible motors (not shown) drive and X shaft 90 and a Y shaft 91 respectively perpendicular to each other. A pinion gear 92 on Y shaft 91 engages and drives a Y rack 93 for moving a support bracket 94 in the Y direction. Bracket 94 carries an X rack 95 meshed with a generally cylindrical and elongated X pinion 96 on shaft 90 to move bracket 94 in the X direction. Bracket 94 is coupled to bracket 97 supporting fiche deck 36 and locater plate 81 as previously described. Correct positioning of fiche deck 36 by shafts 90 and 91 is monitored by a notched disk 98 on shaft 91 and a corresponding notched disk 99 on shaft 90, and the rotational movement of disks 98 and 99 is detected by the passage of notches past photocells 100. Preferably, shafts 90 and 91 turn fairly rapidly in driving disks 98 and 99 to predetermined location positions with some inertial overtravel when the proper position is reached, and then shafts 90 and 91 are reversed at 1/10 speed to bring disks 98 and 99 back to approximately the exact position. The final location of fiche deck 36 is then made accurate by raising tapered pin 84 into a recess in locater plate 81 as previously described. The movement of fiche deck 36 to the proper position for receiving a piece of film preferably occurs while the film piece is being loaded into transfer arm 40 and while transfer arm 40 is moving into position over fiche deck 36.

SECURING FILM PIECE ON FICHE BASE

The way the film piece in transfer arm 40 is accurately secured to fiche base 70 is best shown in FIGS. 8, 9, and 13–16. A depositor bar 101 extends along transfer arm 40 between clamp bars 60 and 61 and is pivoted along one edge on pins 102 secured in mounting blocks 103 for pivoting downward against the bias of spring 104. A pair of cantilever spring arms 105 secured by a plate 136 at the top of depositor bar 101 extend outward through openings 106 in clamp bar 60 which has oblong openings 107 allowing vertical motion of clamp bar 60 relative to support pin 65. A pair of pins 108 are loosely mounted in transfer arm 40 and extend above transfer arm 40 to be engaged by presser bar 39. A pair of set screws 109 with internal spring-loaded plungers are adjustably mounted in presser bar 39 for engaging pins 108.

Figure 13:
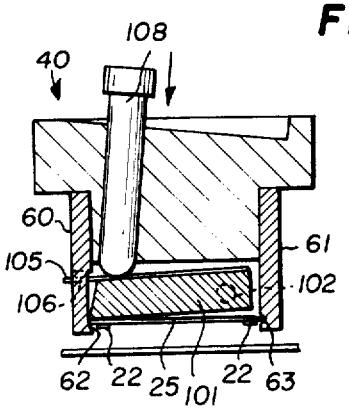
FIGS. 13–15 are cross-sectional views of the transfer arm of the apparatus of FIG. 1 showing the operations involved in securing a filmstrip to a fiche base.

The film piece 25 supported between clamp bars 60 and 61 must be secured on fiche base 70 in a highly accurate registry with a predetermined destination region on fiche base 70. After transfer arm 40 has moved into engagement with the delivery position stop 38, and the fiche deck carrying base 70 has been accurately positioned by a detent pin as explained above, then presser bar 39 moves downward to press adjustable screws 109 against pins 108 to start pivoting the movable edge of depositor bar 101 downward against the bias of springs 104. The events that follow are best shown in FIGS. 13–15.

Depositor bar 101 moves a short distance downward to engage the top surface of film piece 25 and to bring cantilever springs 105 to the bottom of openings 106 in clamp bar 60. As depositor bar 101 continues to pivot downward in response to downward motion of pins 108, clamp bar 60 is driven downward by springs 105 to the lower limit of its travel where the top of openings 107 (FIG. 9) engage support pins 65. The lower end of clamp bar 60 is then very close to the upper surface of fiche base 70, and film piece 25 and depositor bar 101 are still above the bottom of clamp bar 60 as shown in FIG. 13.

Figure 14:
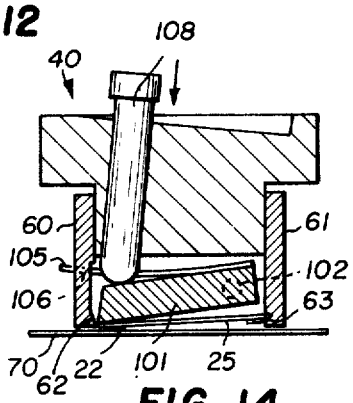

With further pivoting as shown in FIG. 14, depositor bar 101 moves downward relative to clamp bar 60 and cantilever springs 105 to slide the side edge of film piece 25 downward along the lower tapered surface 62 of clamp bar 60. At the bottom of the downward stroke of presser bar 39, as established by adjustable screws 109 engaging pins 108, depositor bar 101 moves below the bottom of clamp bar 60 to press one edge of film piece 25 against the upper surface of fiche base 70. This secures one of the adhesive strips 22 to fiche base 70 as shown in FIG. 14.

Figure 15:
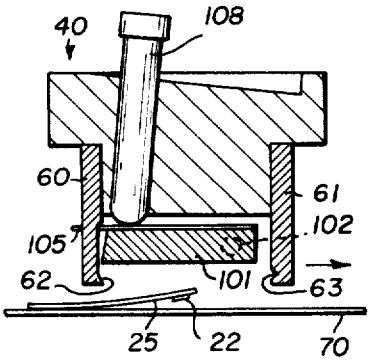

Then presser bar 39 retracts and raises back upward above transfer arm 40, and depositor bar 101 pivots upward under the bias of springs 104 and raises clamp bar 60 by lifting up on springs 105 to return the film-depositing parts to the position shown in FIG. 15. Transfer arm 40 begins to pivot back to its film-receiving position in a motion as indicated by the arrow in FIG. 15, and as soon as this motion occurs, the other edge of film piece 25 drops out of notch 63 in clamp bar 61 and falls down against fiche base 70. Transfer arm 40 then pivots freely over film piece 25 and returns to its film-receiving position.

Figure 16:
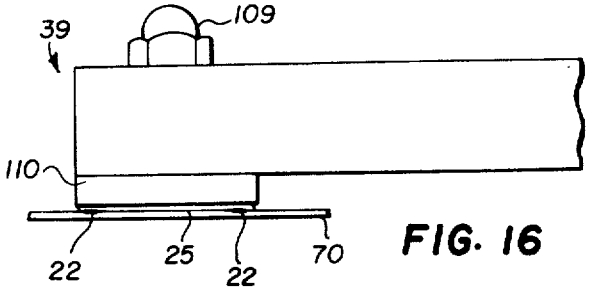
FIG. 16 is a fragmentary, side elevational view of the presser bar of the apparatus of FIG. 1 securing a film piece on a fiche base.

Then presser bar 39 moves all the way downward to the position shown in FIG. 16 in a second downward stroke to bring resilient pad 110 into engagement with film piece 25 on fiche base 70 to forcefully press both adhesive strips 22 against fiche base 70 for a secure bonding of film piece 25 in place. Presser bar 39 then retracts to its home position above transfer arm 40 and awaits the next operating cycle.

CAM SYSTEM FOR MOUNTING OPERATIONS

Figure 17:
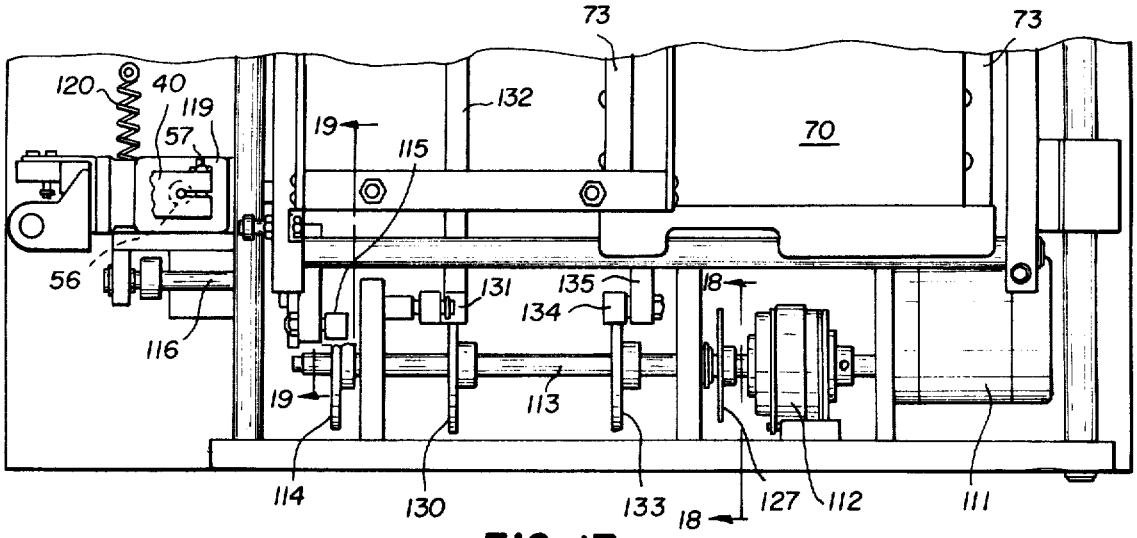
FIG. 17 is a fragmentary plan view of a cam system for the apparatus of FIG. 1.

All the motions required for mounting film pieces on a fiche base are preferably provided by a cam system, although other devices could also be used. As best shown in FIG. 17, a motor 111 drives continuously through an electromagnetic clutch 112 that engages periodically to turn shaft 113 one full revolution for each operating cycle. Several cams are mounted on shaft 113 and also rotate one full revolution each cycle, and followers derive the necessary fiche mounting motions from the cams.

Figure 19:
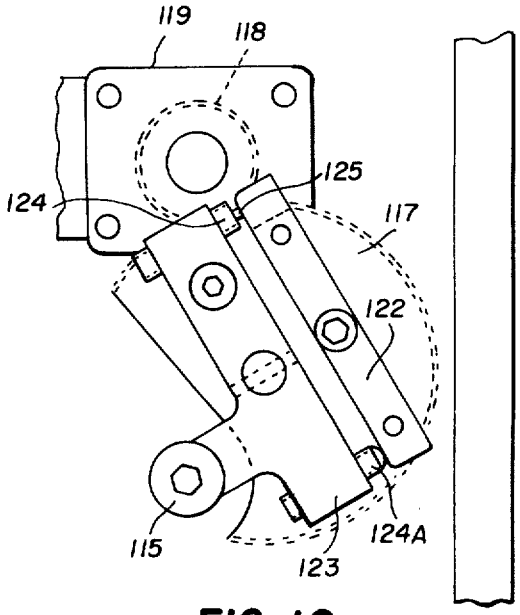
Figure 20:
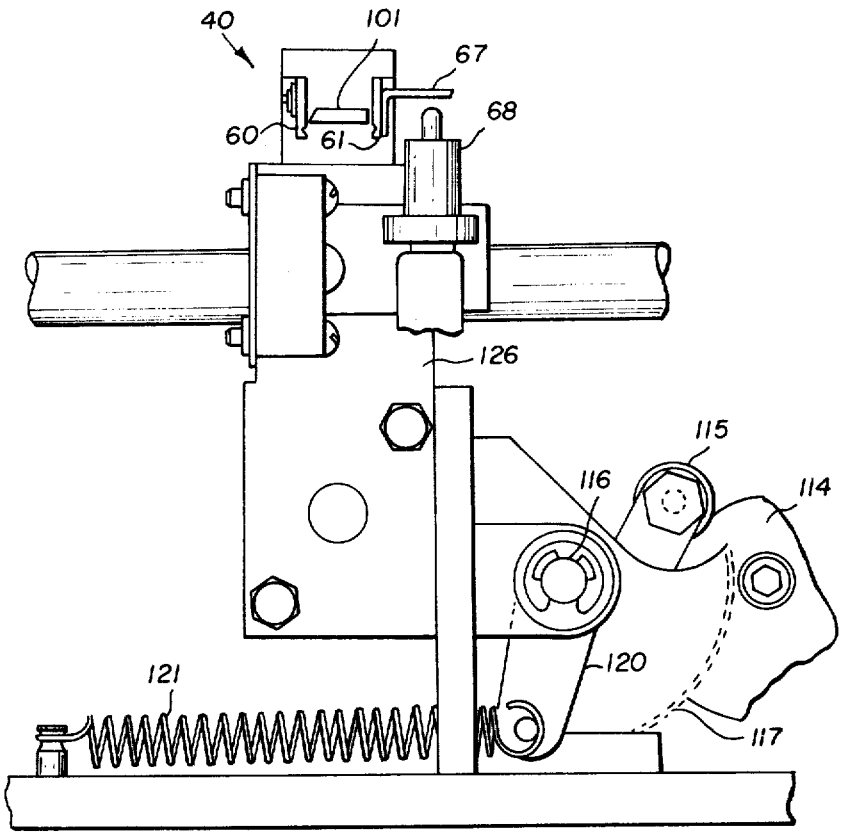
FIG. 20 is a fragmentary, side elevational view of another portion of the cam system of FIG. 17.

As best shown in FIGS. 17, 19, and 20, a first cam 114 is tracked by a follower 115 to turn a shaft 116 that carries a gear sector 117 that meshes with a gear 118 that drives a gear reducer 119 that turns the shaft 56 on which transfer arm 40 is clamped by screw 57. An arm 120 on shaft 116 is connected to a spring 121 that biases shaft 116 and gear sector 117 back toward the home or film-receiving position for transfer arm 40, and the drive train from cam 114 to shaft 56 operates to pivot transfer arm 40 through a 180° arc from the film-receiving position to the film-delivery position as described above.

Follower 115 drives gear sector 117 through a coupling best shown in FIG. 19 to insure that transfer arm 40 is held firmly against the adjustable stops for each operating position of the transfer arm. The coupling is formed by a bar 122 secured to gear sector 117, a generally parallel bar 123 moved by follower 115, and a spring-biased pin device 124 and an adjusting screw 124A secured to bar 123 and engaging bar 122. Pin device 124 includes a spring-loaded pin or plunger 125 biased outwardly to press against bar 122. When transfer arm 40 is moving under light pressure between stops, pin device 124 and adjusting screw 124A exert a balanced pressure on bar 122, and the depositing stop position is reached, follower 115 drives to press pin device 124 firmly against bar 122 to insure that transfer arm 40 is held firmly against the stop. The spring-biased pressure pin device 124 working against adjusting screw 124A and the adjustability of position stops 69 and 38 (described above), cause transfer arm 40 to be accurately and firmly located in each of its operating positions.

Figure 18:
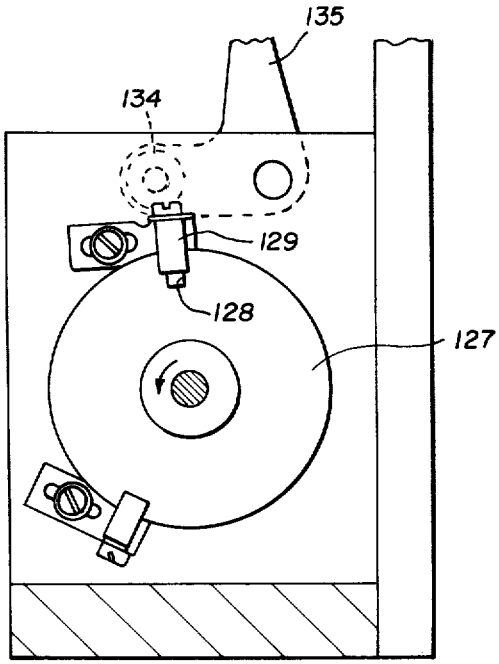
FIGS. 18 and 19 are fragmentary, side elevational views of portions of the cam system of FIG. 17.

A timing disk 127, best shown in FIGS. 17 and 18, is mounted on shaft 113 and has a notch 128 whose position is detected by a photocell unit 129 for operating clutch 112 to stop cam shaft 113 after a full revolution. Other devices can also be used to insure one full revolution of cam shaft 113 for each operating cycle.

Another cam 130 on shaft 113 is tracked by a follower 131 to move an operating arm 132 for raising and lowering presser bar 39 for its two operating strokes for each cycle as described above. Another cam 133 on shaft 113 is tracked by a follower 134 for operating an arm 135 that raises and lowers tapered pin 84 (FIGS. 11 and 12) for locking the locater plate of the fiche deck into proper position as explained above. Pin 84 can also be operated by a solenoid, and other mechanisms can be substituted for the cam system for operating the components involved in mounting the film pieces on the fiche base.

CONTROL AND ERROR DETECTION

To accommodate both automatic and manual operation, the switches in control panel 19 (FIG. 1) preferably include switches for power, standby, manual operation, cut, mount, carriage home, load, and next event, with the load, cut, and mount switches being operable in the manual mode, and the machine being automatic in response to the next event switch. The keyboard 18 preferably has switches for entering mounting data for any frames that, through some mishap, lack mounting data.

Diagnostic panel 13 displays some error conditions indicated by red lights, and some operating events, preferably indicated by green lights, to aid in troubleshooting machine 10 and correcting any errors that occur. The indications on diagnostic panel 13 are derived from switch devices properly positioned in machine 10 to actuate when certain events occur. For example, instructional errors in the form of inoperable frame location numbers, instructions requiring reversal of the fiche deck 36 to a lower-numbered destination region or a destination region having a number higher than 98 operate to present error displays on panel 13. Another switch signals excess film if more than fourteen frames are driven into transfer arm 40, and other switches produce error signals if the film supply motor stays on too long or if fiducial marks 44 do not pass mark sensors at a certain rate when the film supply motor is on. Other switches monitor the position of the fiche deck, indicate the presence of a fiducial mark at a mark sensor, and indicate when the film is positioned on the fiche base. Any event or operation in machine 10 can be, and preferably is, monitored by a switch either in the form of a microswitch or a photoelectric sensor to indicate conditions such as the home positions of the cutting knife, the fiche deck, the presser bar, the transfer arm, and other operating positions and events. These aid in diagnosing any problems encountered with machine 10.

VARIATIONS IN THE INVENTION

The illustrated embodiment of machine 10 is preferred for its reliability, economy, and efficiency in operation and maintenance. However, it can be varied considerably within the spirit of the invention to accomplish the same general results. For example, motion-producing devices can be arranged with different sorts of motors, drive trains, cam systems, solenoids, etc. and sensing devices for controlling operations and indicating events and errors can be electromechanical, electro-optical, mechanical, etc. The transfer device for receiving a piece of film and depositing it on the fiche base need not move, and the fiche base can be moved relative to the transfer device. Movement of the transfer device is preferred to remove the film piece from the viewing area where code and fiducial marks are sensed and where the cutoff knife operates. Movement of the transfer device need not be a horizontal pivotal motion, and need not be through a 180° arc, and there are many ways that satisfactory positioning of the transfer device and the fiche deck can be accomplished to insure precise registration of the film piece on the fiche base. The illustrated arrangement for depositing the film piece on the fiche base is preferred for its accuracy and reliability, but variations are possible, providing the accuracy is maintained.

Those skilled in the art will appreciate the many variations and components that can be arranged according to the invention to accomplish the desired results. The invention can be practiced with varying degrees of sophistication, depending upon the job to be done and the capital investment to be made, and workers skilled in the art will understand how to build machines according to the invention to fit different circumstances.

What is claimed is:

1. An automatic apparatus using preprogrammed instructions for applying the image frames of a filmstrip to predetermined destination regions of a fiche base in the making of a microfiche, said apparatus comprising:

a. control means for receiving and implementing said instructions;

b. a transfer device for receiving and holding a predetermined length of said filmstrip, said predetermined length being determined by said instructions as a variable number of said image frames;

c. means responsive to said control means for advancing said filmstrip by a predetermined and variable extent into said transfer device to position said predetermined length of said filmstrip in said transfer device according to said instructions;

d. means for cutting said filmstrip in the inter-frame region behind and adjacent to said predetermined length of said filmstrip;

e. means for supporting said base for movement relative to said transfer device;

f. means responsive to said control means for moving said base supporting means according to said instructions to bring said base into a predetermined one of a plurality of possible relationships with said transfer device for accurately positioning said predetermined destination region of said base in registry with said predetermined length of said filmstrip; and g. means for pressing said predetermined length of said filmstrip from said transfer device accurately into engagement with said destination region of said base for securing said predetermined length of said filmstrip to said base.

2. The apparatus of claim 1 wherein said instructions are encoded in said filmstrip, and said control means includes means for reading said instructions.

3. The apparatus of claim 1 wherein said instructions are stored in a data medium, and said control means includes means for reading said instructions.

4. The apparatus of claim 1 including means for sensing operation of parts of said apparatus, and means for displaying indications in response to said sensing means.

5. The apparatus of claim 1 wherein said base moving means includes X and Y coordinate drive means for said base supporting means, a locater plate movable with said base supporting means, a plurality of recesses in said locater plate corresponding to said destination regions of said base, a destination locater pin, and means for pressing said destination locater pin into one of said recesses to locate said base accurately in one of said destination regions.

6. The apparatus of claim 5 wherein said locater plate has a recess corresponding to a home position, said apparatus includes a home locater pin and means for pressing said home locater pin into said home recess to locate said base supporting means in said home position.

7. The apparatus of claim 1 wherein said filmstrip advancing means includes means for sensing marks on said filmstrip for accurately positioning said filmstrip relative to said cutting means.

8. The apparatus of claim 1 wherein said transfer device is movable between a filmstrip-receiving position and a filmstrip-delivery position.

9. The apparatus of claim 8 including stop means for accurately holding said transfer device in each of said positions.

10. The apparatus of claim 8 wherein said transfer device includes an arm horizontally rotatable between said receiving position and said delivery position over said base.

11. The apparatus of claim 1 wherein said transfer device includes an opposed pair of clamp bars for engaging lateral side edges of said filmstrip for holding said filmstrip.

12. The apparatus of claim 11 including spring bias means for urging said clamp bars into engagement with said filmstrip and means for opening said clamp bars against said spring bias to separate said clamp bars for receiving said filmstrip.

13. The apparatus of claim 11 wherein said transfer device is movable between a filmstrip-receiving position and a filmstrip-delivery position.

14. The apparatus of claim 13 including spring bias means for urging said clamp bars into engagement with said filmstrip and means for opening said clamp bars against said spring bias to separate said clamp bars for receiving said filmstrip.

15. The apparatus of claim 14 wherein said transfer device includes an arm horizontally rotatable between said receiving position and said delivery position over said base.

16. The apparatus of claim 15 including stop means for accurately holding said transfer device in each of said positions.

17. The apparatus of claim 11 including a depositor bar pivotally mounted between said clamp bars and wherein said pressing means moves one edge of said depositor bar downward along one of said clamp bars to press one edge of said predetermined length of said filmstrip against said base.

18. The apparatus of claim 17 including spring bias means for urging the other one of said clamp bars toward said one clamp bar for said engagement with said filmstrip and means for moving said other clamp bar against said spring bias to separate said clamp bars for receiving said filmstrip.

19. The apparatus of claim 17 wherein said one clamp bar is movable vertically and including a lost motion coupling between said depositor bar and said one clamp bar for moving said one clamp bar downward toward said base with said one edge of said predetermined length of said filmstrip.

20. The apparatus of claim 19 wherein a lower inside edge of said one clamp bar tapers inward toward said other clamp bar, and said one edge of said predetermined length of said filmstrip slides down said taper.

21. The apparatus of claim 17 wherein said transfer device is movable between a filmstrip-receiving position and a filmstrip-delivery position.

22. The apparatus of claim 21 including spring bias means for urging the other one of said clamp bars toward said one clamp bar for said engagement with said filmstrip and means for moving said other clamp bar against said spring bias to separate said clamp bars for receiving said filmstrip.

23. The apparatus of claim 22 wherein said transfer device includes an arm horizontally rotatable between said receiving position and said delivery position over said base.

24. The apparatus of claim 23 including a depositor bar pivotally mounted between said clamp bars and wherein said pressing means moves one edge of said depositor bar downward along one of said clamp bars to press one edge of said predetermined length of said filmstrip against said base.

25. The apparatus of claim 24 wherein a lower inside edge of said one clamp bar tapers inward toward said other clamp bar and said one edge of said predetermined length of said filmstrip slides down said taper.

26. The apparatus of claim 25 including stop means for accurately holding said transfer device in each of said positions.

27. The apparatus of claim 8 wherein said pressing means includes a presser bar arranged for engaging said transfer device at said delivery position for pressing one edge of said predetermined length of said filmstrip against said base on a first stroke of said presser bar and for pressing the other edge of said predetermined length of said filmstrip against said base on a second stroke of said presser bar after said transfer device has moved from said delivery position.

28. The apparatus of claim 27 including stop means for accurately holding said transfer device in each of said positions.

29. The apparatus of claim 28 wherein said transfer device includes an arm horizontally rotatable between said receiving position and said delivery position over said base.

30. The apparatus of claim 29 wherein said transfer device includes an opposed pair of clamp bars for engaging lateral side edges of said filmstrip for holding said filmstrip, and a depositor bar pivotally mounted between said clamp bars, and wherein said presser bar moves one edge of said depositor bar downward along one of said clamp bars to press one edge of said predetermined length of said filmstrip against said base on said first stroke of said presser bar.

31. The apparatus of claim 30 including spring bias means for urging the other one of said clamp bars toward said one clamp bar for said engagement with said filmstrip and means for moving said other clamp bar against said spring bias to separate said clamp bars for receiving said filmstrip.

32. The apparatus of claim 30 wherein said one clamp bar is movable vertically, and including a lost motion coupling between said depositor bar and said one clamp bar for moving said one clamp bar downward toward said base with said one edge of said predetermined length of said filmstrip.

33. The apparatus of claim 32 wherein a lower inside edge of said one clamp bar tapers inward toward said other clamp bar, and said one edge of said predetermined length of said filmstrip slides down said taper.

34. The apparatus of claim 30 including projections extending upward from said depositor bar and striker means on said presser bar for engaging said projections to pivot said depositor bar on said first stroke of said presser bar.

35. The apparatus of claim 34 including a compressible pad on said presser bar disposed below said striker means for pressing said predetermined length of said filmstrip against said base on said second stroke of said presser bar.

36. The apparatus of claim 35 including spring bias means for urging the other one of said clamp bars toward said one clamp bar for said engagement with said filmstrip and means for moving said other clamp bar against said spring bias to separate said clamp bars for receiving said filmstrip.

37. The apparatus of claim 36 wherein said one clamp bar is movable vertically, and including a lost motion coupling between said depositor bar and said one clamp bar for moving said one clamp bar downward toward said base with said one edge of said predetermined length of said filmstrip.

38. The apparatus of claim 37 wherein a lower inside edge of said one clamp bar tapers inward toward said other clamp bar, and said one edge of said predetermined length of said filmstrip slides down said taper.

39. The apparatus of claim 35 including stop means for accurately holding said transfer device in each of said positions.

40. The apparatus of claim 39 wherein said transfer device includes an arm horizontally rotatable between said receiving position and said delivery position over said base.

41. The apparatus of claim 30 wherein said instructions are encoded in said filmstrip, and said control means includes means for reading said instructions.

42. The apparatus of claim 30 wherein said instructions are stored in a data medium and said control means includes means for reading said instructions.

43. The apparatus of claim 30 including means for sensing operation of parts of said apparatus, and means for displaying indications in response to said sensing means.

44. The apparatus of claim 30 wherein said base moving means includes X and Y coordinate drive means for said base supporting means, a locater plate movable with said base supporting means, a plurality of recesses in said locater plate corresponding to said destination regions of said base, a destination locater pin, and means for pressing said destination locater pin into one of said recesses to locate said base accurately in one of said destination regions.

45. The apparatus of claim 44 wherein said locater plate has a recess corresponding to a home position, said apparatus includes a home locater pin and means for pressing said home locater pin into said home recess to locate said base supporting means in said home position.

46. The apparatus of claim 30 wherein said filmstrip advancing means includes means for sensing marks on said filmstrip for accurately positioning said filmstrip relative to said cutting means.

* * * * *